US005263443A

United States Patent [19]

Schechter et al.

[11] Patent Number: 5,263,443

[45] Date of Patent: Nov. 23, 1993

[54] HYDRAULIC PHASESHIFTER

[75] Inventors: Michael M. Schechter, Farmington Hills; David L. Boggs, West Bloomfield, both of Mich.

[73] Assignee: Ford Motor Company, Dearborn, Mich.

[21] Appl. No.: 4,735

[22] Filed: Jan. 14, 1993

[51] Int. Cl.[5] ..... F01L 1/34

[52] U.S. Cl. ..... 123/90.17; 123/90.31; 464/2; 464/160

[58] Field of Search ..... 123/90.15, 90.17, 90.31; 464/1, 2, 160

[56] References Cited

U.S. PATENT DOCUMENTS

| | | | |
|---|---|---|---|
| 4,601,266 | 7/1986 | Oldfield et al. | 123/90.15 |
| 4,787,345 | 11/1988 | Thoma | 123/90.17 |
| 4,858,572 | 8/1989 | Shirai et al. | 123/90.12 |
| 4,895,113 | 1/1990 | Speier et al. | 123/90.17 |
| 4,903,650 | 2/1990 | Ohlendorf et al. | 123/90.17 |
| 5,002,023 | 3/1991 | Butterfield et al. | 123/90.15 |
| 5,046,460 | 9/1991 | Butterfield et al. | 123/90.15 |
| 5,056,477 | 10/1991 | Linder et al. | 123/90.17 |
| 5,056,478 | 10/1991 | Ma | 123/90.17 |
| 5,088,456 | 2/1992 | Suga | 123/90.17 |
| 5,090,365 | 2/1992 | Hotta et al. | 123/90.17 |
| 5,107,804 | 4/1992 | Becker et al. | 123/90.17 |
| 5,117,785 | 6/1992 | Suga et al. | 123/90.17 |
| 5,121,717 | 6/1992 | Simko et al. | 123/90.17 |

*Primary Examiner*—E. Rollins Cross
*Assistant Examiner*—Weilun Lo
*Attorney, Agent, or Firm*—Jerome R. Drouillard; Roger L. May

[57] ABSTRACT

A valve timing phaseshifter between two members, such as a crankshaft driven housing and a driven camshaft member, that are hydraulically interconnected by fluid trapped in hydraulic cylinders containing plungers connected to the camshaft, relative movement between the cylinders and plungers providing the phaseshifting and being controlled by a valve that is axially movably mounted within the camshaft and hydraulically connected thereto by sets of helical grooves that are aligned or misaligned as a function of axial movement of the valve in response to the call for phase adjustment, the valve being movable from a neutral position to other positions in opposite directions to control the flow of fluid under pressure to the cylinders to cause the drive and driven members to rotate unitarily or for the camshaft to be advanced or retarded as the case may be, with respect to a conventional timing schedule.

29 Claims, 4 Drawing Sheets

HYDRAULIC PHASESHIFTER

FIELD OF THE INVENTION

This invention relates in general to an automotive engine timing system. More particularly, it relates to a mechanism for phaseshifting one engine component relative to another, such as, for example, a camshaft relative to the engine crankshaft.

BACKGROUND OF THE INVENTION

Most commercially available automotive engines use fixed lift and duration valve timing events. As a result, there is a compromise between the best fuel economy, emission control, and engine power conditions.

Potentially better fuel economy, emission control, and other engine output benefits can be realized if the timing of these events can be varied depending on the engine operating mode.

This invention is directed to several embodiments of a phaseshifting mechanism changing the engine timing from a conventional schedule to accomplish the above objectives. The mechanism comprises a driving member and a member driven thereby hydraulically through a fluid to effect relative rotation between the two at times to change the phasing, a unique valve construction with helical grooving fluid connecting the valve with the driven member controlling the hydraulic operation.

DESCRIPTION OF THE PRIOR ART

Phaseshifters in general are known in the prior art. U.S. Pat. No. 4,858,572, Shirai et al., describes and shows an angular vane type phase adjuster between the engine crankshaft 15, 16 and camshaft 11 utilizing oil pump pressure on opposite sides of the vanes in the chambers to angularly rotate the camshaft. A solenoid actuated, spring returned slide valve is used to control direction of oil flow.

There is no use of the movement of a helically grooved valve to control movement of a plunger in a pressure balanced chamber, nor is there a return of the vane to a new neutral position after each movement.

U.S. Pat. No. 5,002,023 and U.S. Pat. No. 5,046,460, Butterfield et al., both show and describe a dual camshaft, self actuating phaseshifter in which a crankshaft driven member and a camshaft are interconnected by a hydraulic system including hydraulic cylinders containing oppositely moving plungers that automatically react to the engine's torque pulses to advance or retard the timing. When one extends in one direction, the other retracts in the opposite direction. The plungers are movable in bores in the crankshaft driven housing, as controlled by oil pressure controlled by a spool valve 92 (FIG. 12). The valve can be moved by fluid pressure from one spring biased position to either a neutral position or another active position. The valve movement is controlled as a function of an engine parameter controlled computer.

The plungers move at right angles to the camshaft axis so as to rotate the camshaft upon movement of the plungers. The plungers do not operate in balanced pressure fluid chambers, and are not controlled by a hydraulic system utilizing a helically grooved valve connected to the crankshaft for rotation therewith and hydraulically connected to the camshaft to control the plunger movement and return to a new neutral position after each phase change movement.

U.S. Pat. No. 4,903,650, Ohlendorf et al., shows and describes a rotary vane type angular Phase adjuster between a crankshaft driven sprocket wheel 1 and a camshaft 7. An axial bore contains a slidable, spring returned valve/plunger 13 actuated by an electromagnet 18 to control flow of oil to or from fluid chambers on opposite sides of the vane 9. The control system does not utilize a valve and camshaft with helical grooves and a pressure balanced/unbalanced fluid chamber to effect movement of the plunger/vane and return to a new neutral position after each movement to be ready for advance or retard from the new position.

Many of the prior art references effect relative Phase adjustment movement by the use of helical splines/-straight splines sets directly between the members, and a fluid control system, but not one using a valve having helical grooves between the driven member and the valve to control fluid flow in the unique manner to be proposed.

For example, U.S. Pat No. 4,895,113, Speier et al., shows and describes an angular phaseshifter between a crankshaft driven sprocket wheel 3 and a camshaft 11. An annular piston 6 is helically splined between the sprocket 3 and camshaft and axially movable to change the angular relation between the two by admitting fluid to and draining fluid from opposite chambers/sides of the piston. A spring biased control piston 17 is located in an axial bore and moved against the bias by an electromagnet 22 to supply oil pressure to one side of the piston to advance the camshaft, oil draining to the sump from the other side of the Piston. Turning off the electromagnet returns the valve 17 to its base camshaft retarded position. In this case, the helical grooves, per se, effect the angular movement. No valve with helical grooves controls a hydraulic circuit to a plunger to move the camshaft. The helical teeth provide the movement, not the valve controlling movement of the plunger/cylinder.

U.S Pat. No. 4,787,345 Thoma, describes and shows a phase adjusting mechanism between a crankshaft driven member 6 and a camshaft 1. The two are interconnected for relative angular rotation through the agency of helical and straight splines between. A piston 23 is movable to effect the angular displacement, the piston movement being controlled by pressure fluid controlled by a valve 51.

U.S. Pat. No. 4,601,266, Oldfield et al., shows and describes a phase adjuster in which a crankshaft driven member 21 is helically splined to a driven camshaft member 26 by a cam 89. A piston 20 is infinitely variably movable in opposite directions by engine oil pressure to effect the angular rotation of one member relative to the other. Solonoid operated valves provide a lock of the piston in a particular position. The relative rotation is effected by helically forcing axial movement, not by hydraulic pressure.

U.S. Pat. No. 5,090,365, Hotta et al., shows and describes a phaseshifter wherein a crankshaft driven member and camshaft are interconnected helically and angularly rotated relative to one another by axial movement of a piston under oil pressure.

U.S. Pat. No. 5,088,456, Suga, shows and describes a camshaft 1, and a crankshaft driven member 8 with spiral gear teeth moved by oil pressure to effect angular rotation between the crankshaft and camshaft.

SUMMARY OF THE INVENTION

The invention relates to a valve timing phaseshifter consisting of a driving member such as a crankshaft driven housing and a driven member such as a camshaft, that are hydraulically interconnected by fluid trapped in hydraulic cylinders containing plungers connected to the camshaft; relative movement between the cylinders and plungers providing the phaseshifting and being controlled by a valve that is axially movably mounted within the camshaft and hydraulically connected thereto by sets of helical grooves that are aligned or misaligned as a function of axial movement of the valve in response to the call for phase adjustment, the valve being movable from a neutral position to other positions in opposite directions to control the flow of fluid under pressure to the cylinders to cause the drive and driven members to rotate unitarily or for the camshaft to be advanced or retarded as the case may be, with respect to a conventional timing schedule.

It is, therefore, a primary object of the invention to provide an automotive timing system with a phase adjusting mechanism that will phaseshift a pair of rotating components by means of a hydraulic system that hydraulically interconnects the two in a manner controlled by a valve mechanism, the latter being fluid connected to one of the members by sets of helical grooves in the valve and member, the valve being axially movable to and from a neutral position to control a supply of fluid under pressure to cause the phase change to be effected when desired.

Other objects, advantages and features of the invention will become more apparent upon reference to the succeeding, detailed description thereof, and to the drawings illustrating the preferred embodiments thereof.

DESCRIPTION OF THE PREFERRED EMBODIMENTS

Figure 1:
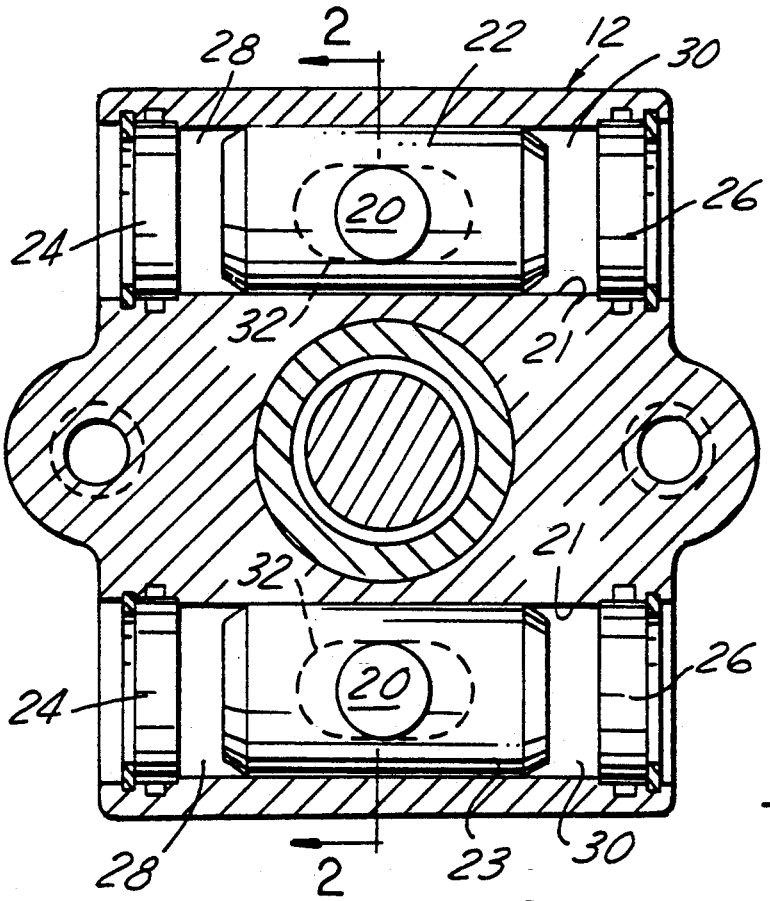
FIG. 1 is a cross-sectional view of a portion of an automotive type engine embodying the invention.

FIG. 1 shows a phaseshifter consisting of two main bodies, a crankshaft driven annular housing 12, and a camshaft 14. The engine crankshaft (not shown) could be connected to housing 12 by means of a sprocket wheel (not shown), or by any other suitable means.

The housing has a central bore 16 that rotatably receives within it the tubular camshaft 14. The camshaft has a vertical flange 18 that extends radially from the shaft, the flange mounting a pair of pins 20 at right angles to it. A pair of cylindrical bores 21 are machined in the housing and located symmetrically on opposite sides of the housing axis, a plunger 22, 23 being installed in each. The open ends of the bores are closed by plugs 24, 26 to define hydraulic cylindrical chambers 28 and 30 between the plunger and the plugs, all four chambers being filled with oil.

Figure 2:
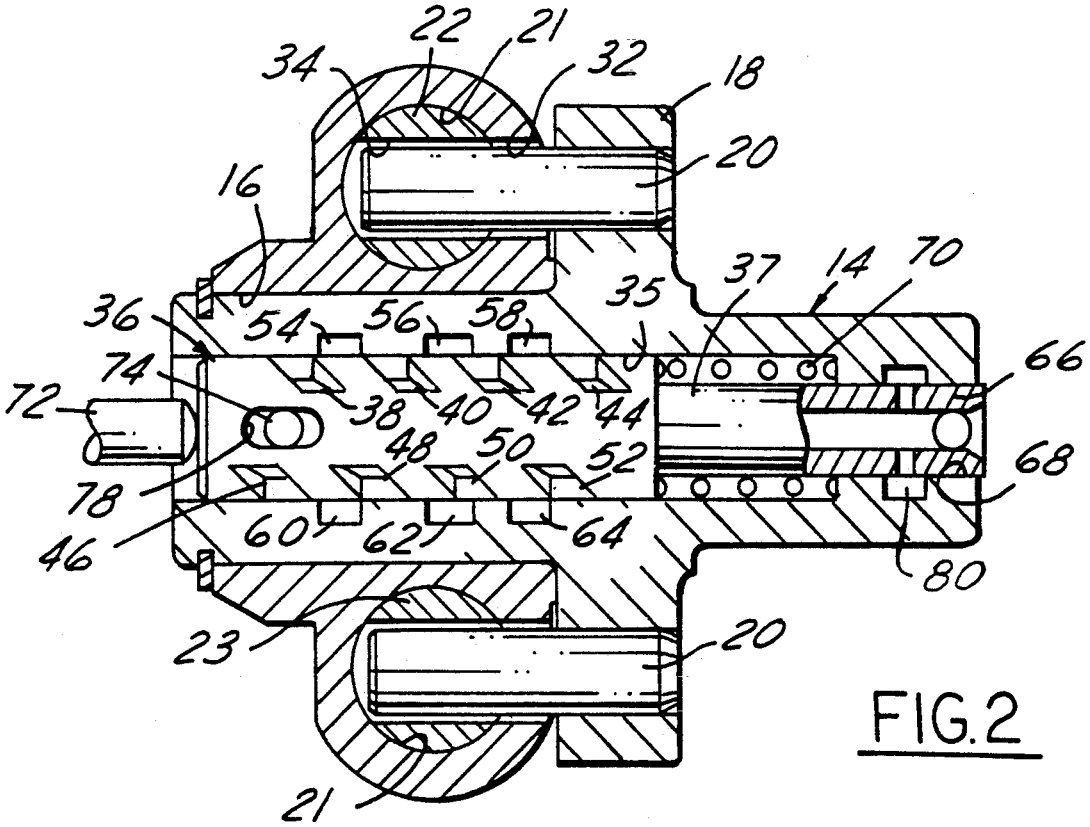
FIG. 2 is a cross-sectional view taken on a plane indicated by and viewed in the direction of the arrows II—II of FIG. 1.

The pins 20 are fixed to the plungers as shown in FIGS. 1 and 2 by protruding through slots 32, 34 in the housing 12 and plunger 22. As seen in FIG. 1, the slot 32 in the housing is elongated or oval shaped to permit a limited lateral relative movement between the plunger and the housing. The engagement of the pin to the plunger is such that any axial movement of a plunger in its bore causes a concurrent rotation of the flanged shaft 14 relative to the housing 12.

Figure 3:
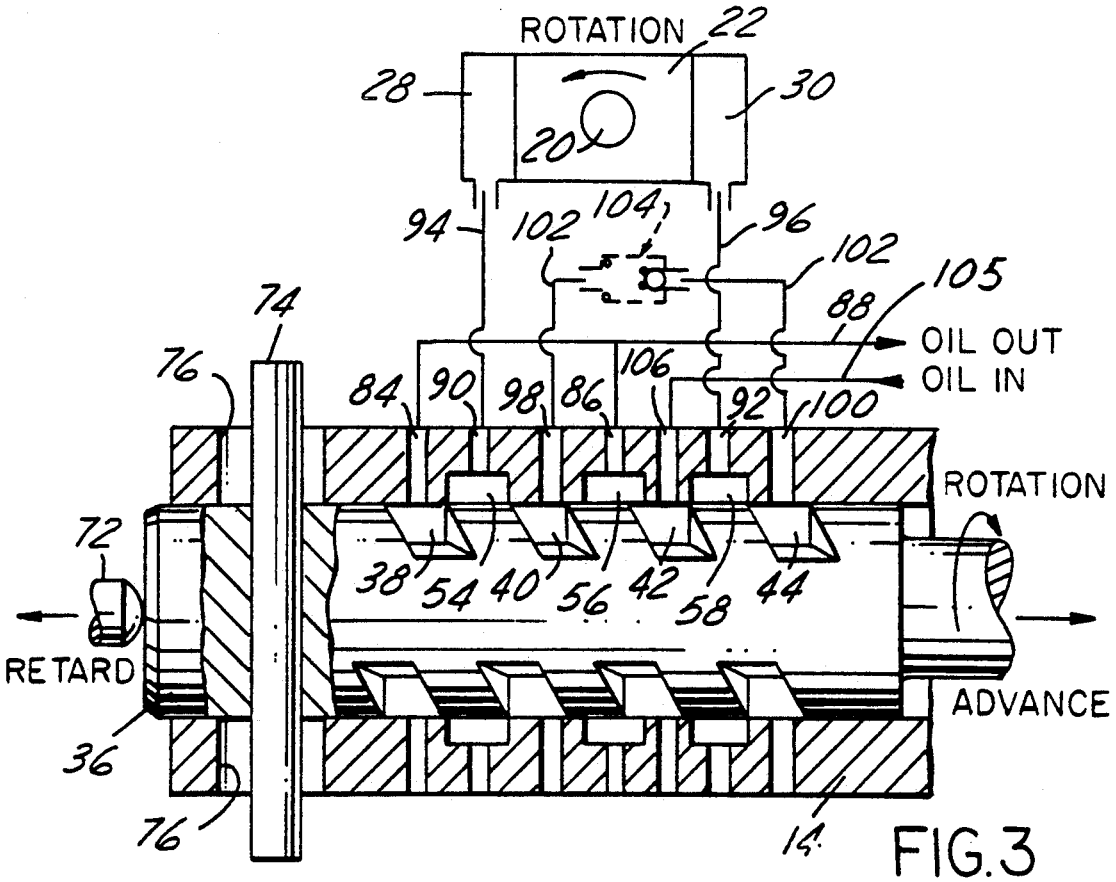
FIGS. 3, 4, and 5 are diagrammatic representations of three different hydraulic control systems embodying the invention.

The tubular or sleeve-like camshaft 14 is adapted to receive within its hollow interior 35 a cylindrical slide valve 36. The valve has a stepped diameter body 37, with two sets of helical grooves 38, 40, 42, 44, and 46, 48, 50, 52 machined on its outer surface (FIG. 3). The grooves are adapted to mate or be aligned or misaligned at times with two corresponding sets of helical grooves 54, 56, 58, and 60, 62, 64 machined in the inner wall of the camshaft 14.

The valve 36 is mounted for an axial movement within the camshaft, with the smaller diameter body portion 66 projecting sealingly through an opening 68 in the camshaft end wall, as shown. A spring 70, seated between the valve and wall of the camshaft, biases the valve to the left, in a timing retard direction, as will become more clear later. The opposite end of the valve abuts the end of a pushrod 72 that is part of a separate control mechanism, not shown. Selective movement of the pushrod will move the valve 36 to the right against the force of spring 70 in a timing advance direction, as indicated in FIG. 3, for example.

The control valve 36 rotates in unison with the housing 12 by means of a pin 74 that is press fitted into the hub of the housing. It passes through elongated holes 76 (FIG. 3) in the camshaft 14, and engages the valve through a slot 78 that permits axial displacement of the valve.

Oil, supplied by an outside pump, flows through internal passages in the phaseshifter, indicated partially at 80 (FIG. 1) in the valve end, and returns to the sump, which often is the engine crankcase. The valve can be moved in opposite directions from a neutral position to a retard position or to an advance position, as indicated previously, to effect a corresponding movement of the plunger to advance or retard the engine timing.

FIG. 3 illustrates diagrammatically the hydraulic connections in the phaseshifter. In FIG. 3, for clarity, the axis of plunger 22 is shown in the same plane as the axis of valve 36; in reality, the axes of the plunger and the valve are in perpendicular planes, as shown in FIG. 1.

The corresponding sets of internal and external helical grooves 38–44 and 54–58 are part of a hydraulic circuit controlling the position of the plunger 22 in its bore. The other set of internal and external helical grooves 46–52 and 60–64 is part of a circuit controlling the second plunger 23 (FIG. 2), which is not shown as the operation is identical. The hydraulic connections are arranged so that the hydraulic forces acting on the two plungers 22, 23 form a force couple about the valve axis indicated in FIG. 1.

FIG. 3 indicates the control valve 36 in a neutral position. Grooves 54 and 58 are connected through camshaft passages 90 and 92 and lines 94 and 96 to the end chambers 28 and 30. Grooves 40 and 44 are connected to each other through camshaft passages 98 and 100 and a line 102. Line 102 contains a one-way check valve 104, for a purpose to be described later. Grooves 38 and 56 are connected to the engine oil sump through a pair of passages 84 and 86 in camshaft 14, and a return line 88. Oil under pressure from a pump, such as the engine oil pump, is supplied through an inlet line 105 and a camshaft inlet passage 106 to the groove 42. Grooves 42 and 56 are directly connected so that oil delivered to groove 42 flows through groove 56 back into the sump. The grooves 54 and 58 are blocked and remain isolated from the rest of the circuit so that the oil in chambers 28 and 30 is trapped there When the pushrod 72 is activated in response to predetermined engine parameters to move the valve 36 to the right to advance the timing, the passage between grooves 42 and 56 is drastically reduced, throttling the oil flow and increasing the pressure in the groove 42. At the same time, groove 42 becomes connected to groove 58, and groove 38 becomes connected to groove 54. As a result, pressurized oil is delivered through grooves 42 and 58 to the chamber 30, forcing the plunger 22 to move in the direction of rotation. The oil previously trapped in chamber 28 flows out through the grooves 54 and 38 to the sump. The motion of the plunger 22 is transmitted through pin 20 to the camshaft 14, which advances relative to the housing 12 and relative to the valve 36. Since the grooves on the valve 36 and in the camshaft 14 are helical, rotation of the camshaft 14 relative to valve 36 has an effect similar to that as if valve 36 is subjected to axial displacement. The angular motion of camshaft 14 and the grooves 54, 56 and 58 relative to the valve 36 and the grooves 38, 40, 42, and 44 in the direction of overall rotation indicated, now opens the passage between the grooves 42 and 56 and isolates the grooves 54 and 58. Therefore, a new neutral position of the valve 36 is reached, and the advance motion of the camshaft 14 stops. The angle of advance of the camshaft 14 relative to the housing 12 is proportional to the axial displacement of the valve 36 in the direction of advance to the right.

When the valve 36 is moved to the left, groove 54 becomes connected to groove 40 and the groove 58 becomes connected to the groove 44. As a result, the chambers 28 and 30 become connected and, since for the given direction of rotation and the mean driving torque, the mean pressure in the chamber 30 is higher than in the chamber 28, oil flows from the chamber 30 to the chamber 28. The plunger 22 moves in the direction opposite to the direction of rotation and its motion is transmitted through the pin 20 to the camshaft 14 which lags in its rotation behind the housing 12 and the valve 36. The relative angular motion of the camshaft 14 relative to the valve 36 in the direction opposite to the direction of overall rotation isolates the grooves 54 and 58 from the grooves 40 and 44, respectively. A new neutral position of the valve 36 then is reached, and the retard motion of the shaft 12 stops. The angle of retard of the camshaft 14 relative to the housing 12 is proportional to the axial displacement of the valve 36 in the direction of retard to the left.

During engine operation, the camshaft 14 is subjected to a continuous series of reaction torque pulses of alternating direction, which are associated with opening and closing of the engine valves. During the engine valve opening, the reaction torque is directed against the direction of rotation and leads to increased pressure in the chamber 30. During the engine valve closing, the direction of the reaction torque coincides with the direction of rotation, and leads to increased pressure in chamber 28. When the valve 36 is moved to the left and the chambers 28 and 30 become connected, oil flows from the chamber 30 to the chamber 28 during engine valve opening and can also flow back from the chamber 28 to the chamber 30 during engine valve closing. Since the magnitude of the torque directed against the rotation is larger than that directed with rotation, the net flow is from the chamber 30 to chamber 28 and the camshaft 14 is retarded, but the intermittent reversals of oil flow slow down the response of the device. To improve the response, the check valve 104, indicated in dotted lines, can be incorporated in the passage connecting the grooves 40 and 44 in FIG. 3. The check valve permits oil to flow from the chamber 30 to chamber 28 but prevents reverse flow in the opposite direction.

It should be noted that the above described system is inherently self-adjusting and self-compensating. Any inadvertent and unintended phaseshift of the camshaft 14 relative to the housing 12 would be automatically corrected by hydraulic action and the original Phase relation would be restored without need to adjust the position of the valve 36. Such inadvertent phaseshift is most likely to be a retard of the camshaft 14 due to internal leakage from and between the chambers 28 and 30. Such a retard of the camshaft 14 relative to the valve 36 creates conditions equivalent to those which exist when the valve 36 is moved to the right. This, in turn, causes the camshaft 14 to advance until the previous phase relation is restored. Each axial position of the valve 36 determines a specific phase relation between the housing 12 and the camshaft 14 which is automatically maintained by the hydraulic system.

It should also be noted that, in the above system, input of energy needed to perform the phaseshift is required only during the phaseshift towards advance when fluid under pressure effects the move. No energy input is needed to perform the retard because the two chambers are interconnected with the supply source blocked off, thereby eliminating the need for a pressure source buildup. Likewise, no energy is consumed at steady state conditions between the phaseshifts when again the supply source is returned to sump.

Figure 4:
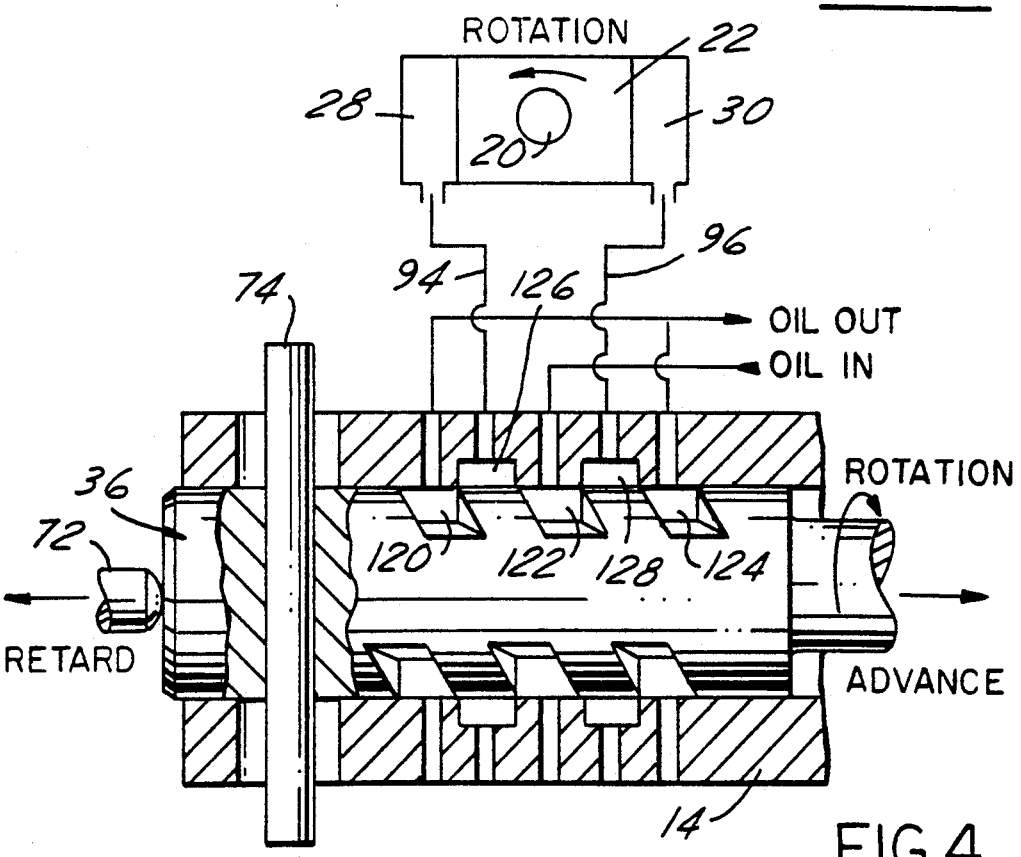

FIG. 4 illustrates an alternative embodiment of the phaseshifter. In this case, the set of short external helical grooves on each side of the valve 36 consists of only three grooves 120, 122, and 124, and the corresponding set of internal grooves in the camshaft 14 consists of two grooves 126 and 128. Oil pressure is supplied to groove 122 from an external hydraulic circuit. Such pressure can be generated in the external circuit by various means, such as for example, by a pump pumping oil through a pressure regulating valve. Grooves 120 and 124 are connected to the return to sump line indicated. Grooves 126 and 128 are connected to the chambers 28 and 30, respectively. The valve 36 is shown in neutral position. In this position, the grooves 126 and 128 remain isolated from the grooves 120, 122 and 124, and the oil in the chambers 28 and 30 is trapped therein.

When the valve 36 is moved to the right to advance the timing, groove 122 becomes connected to groove 128, and groove 120 is connected to groove 126. As a result, Pressurized oil is delivered through grooves 122 and 128 and the lines indicated to the chamber 30, forcing the plunger 22 to move in the direction of rotation, while the oil previously trapped in the chamber 28 flows out through the grooves 126 and 120 to the sump. The remaining action is similar to what was described before, and the camshaft advances relative to the housing 12 until a new neutral position of the valve 36 is reached.

When the valve 36 is moved to the left, groove 122 becomes connected to groove 126, and groove 124 is connected to groove 128. As a result, pressurized oil is delivered through grooves 122 and 126 to the chamber 28, forcing the plunger 22 to move counter to the direction of rotation, while the oil previously trapped in the chamber 30 flows out through grooves 128 and 124 to sump. The camshaft 14 lags behind the housing 12 until a new neutral position of the valve 36 is reached. This operation differs from that previously described in that the retard motion is performed under the force of the Pressurized oil instead of engine reaction torque pressurizing chamber 30.

Figure 5:
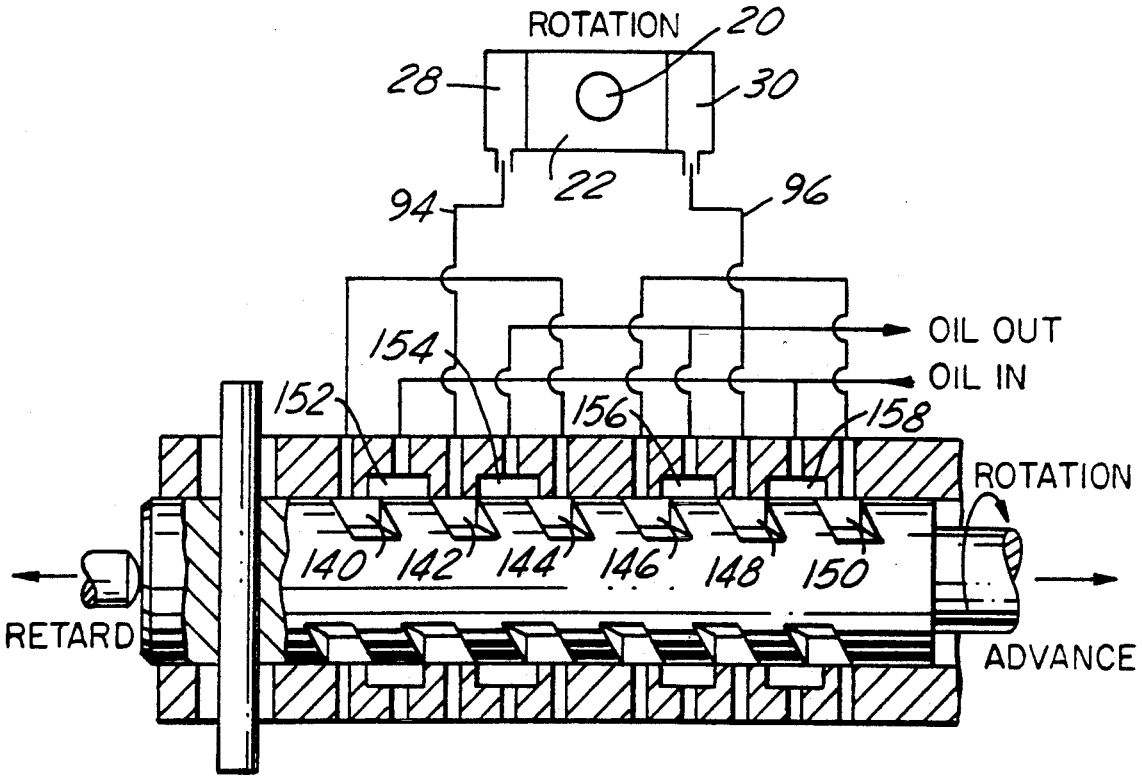

FIG. 5 shows still another modification of the phaseshifter. In this case, the set of short external helical grooves on each side of the valve 36 consists of six grooves, 140, 142, 144, 146, 148, and 150; and the corresponding set of internal grooves in the camshaft 14 consists of four grooves 152, 154, 156, and 158. As it was the case in the diagram in FIG. 3, oil is supplied by an outside pump, flows through the phaseshifter and returns to the sump. In any neutral position there is no need to increase the oil pressure.

Oil supplied by the pump is delivered to the grooves 152 and 158. Grooves 154 and 156 are connected to the return to sump line. Grooves 142 and 148 are connected to the chambers 28 and 30, respectively. Groove 140 is connected with groove 144, and groove 146 is connected with groove 150. The valve 36 is shown in neutral position, wherein the groove 142 remains isolated from the grooves 152 and 154. The groove 148 is isolated from the grooves 156 and 158; and, therefore, the oil in the chambers 28 and 30 is trapped therein.

When the valve 36 is moved to the right, the passages between the grooves 144 and 154 and between the grooves 150 and 158 are reduced, throttling the oil flow and increasing the pressure in the groove 158 which becomes connected to groove 148. As a result, pressurized oil is delivered through the grooves 158 and 148 to the chamber 30, forcing the plunger 22 to move in the direction of rotation while the oil previously trapped in the chamber 28 flows out through the grooves 142 and 154. The remaining action is again similar to that previously described, and the camshaft 14 advances relative to the housing 12 until a new neutral position of the valve 36 is reached.

When the valve 36 is moved to the left, the passages between the grooves 140 and 152, and between grooves 146 and 156, are reduced, throttling the oil flow and increasing the pressure in the groove 152 which becomes connected to the groove 142. At the same time, the groove 148 becomes connected to the groove 156. As a result, pressurized oil is delivered through the grooves 152 and 142 to the chamber 28 forcing the plunger 22 to move in the direction opposite to the direction of rotation, while the oil previously trapped in the chamber 30 flows out through the grooves 148 and 156. The camshaft 14 is retarded relative to the housing 12 until a new neutral position of the valve is reached.

The concept illustrated in FIG. 5 is similar to that of FIG. 4 in that both the advance and retard motions are performed with the use of pressurized oil. However, unlike the concept of FIG. 4, it does not require a continuous supply of prepressurized oil because, like the FIG. 2 construction, oil Pressurization takes place only during advance or retard movements, and there is no hydraulic energy consumption between the phaseshifts. The oil is circulated back to the sump under these conditions without a pressure buildup.

From the foregoing, it will be seen that the invention provides a number of phaseshifting concepts utilizing a valve axially movable within one member and being rotatable with another member, and hydraulically interconnecting the two by means of sets of helical grooves matingly arranged to supply fluid under pressure at times to hydraulic cylinders containing movable Plungers trapped therein as a function of the movement of the valve.

While the invention has been shown and described in its preferred embodiments, it will be clear to those skilled in the arts to which it pertains, that many changes and modifications may be made thereto without departing from the scope of the invention. For example, in all of the above described concepts, the valve 36 was moved to the right for advance and to the left for retard. This was the result of the selection of right-handed helical grooves. It will be clear that the direction of the valve motions could be reversed, if the hand of the helix is changed.

Figure 6:
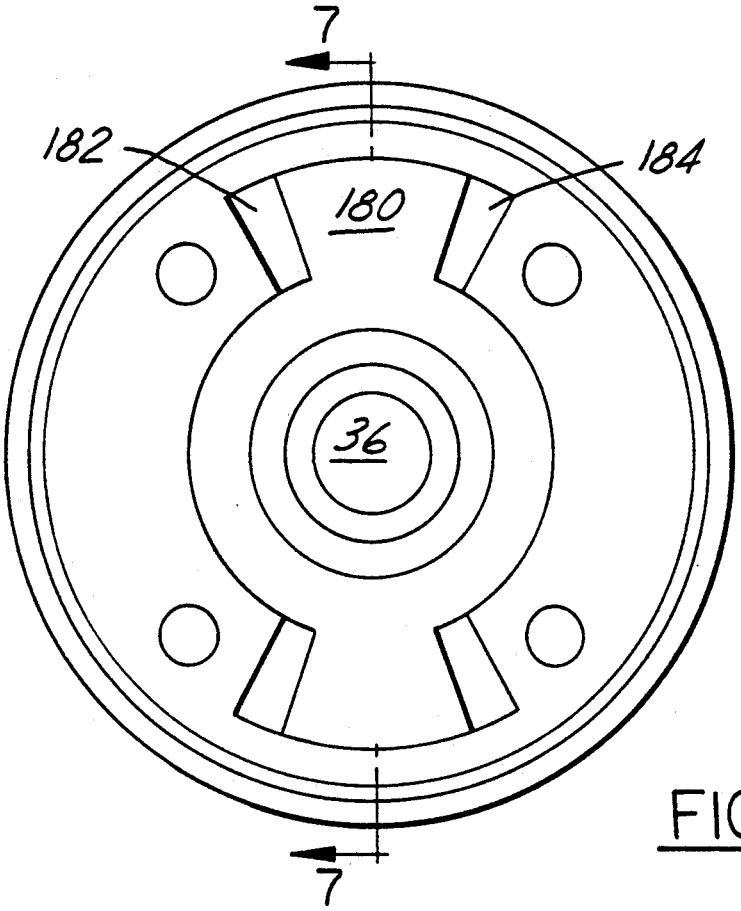
FIG. 6 is a cross-sectional view of a further embodiment of the invention.
Figure 7:
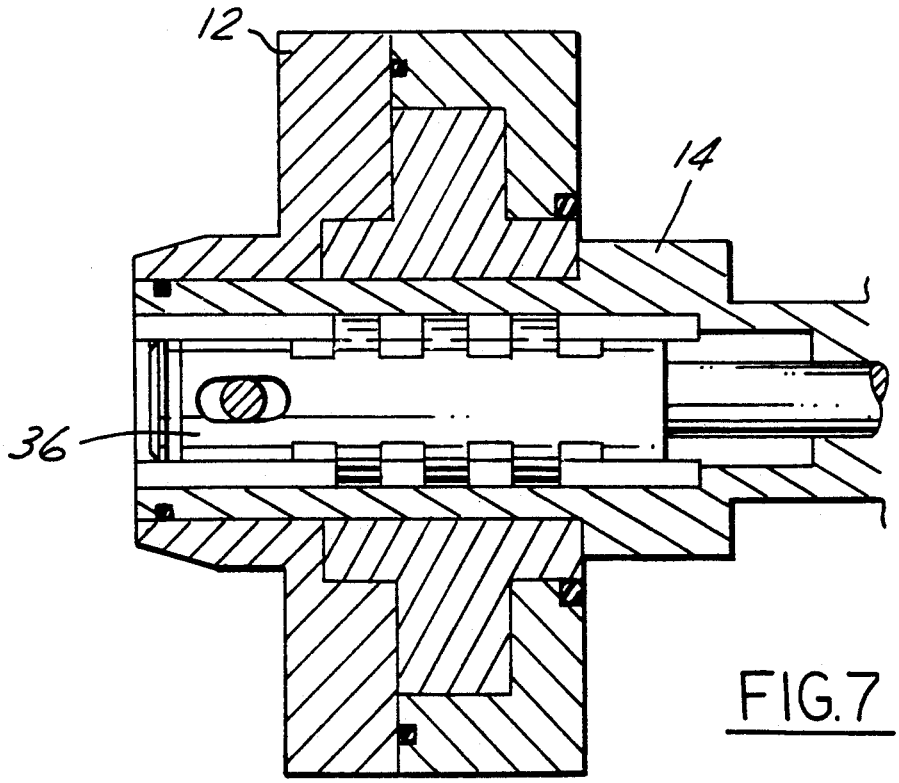
FIG. 7 is a cross-sectional view taken on a plane indicated by and viewed in the direction of the arrows VII—VII of FIG. 6.

Also, while the described mechanisms used only two plungers 22, 23 each. Three or even more could be used without departing from the scope of the invention. Still further, while plungers were described and shown, vanes, pistons, diaphragms and other similar devices capable of transmitting motion and force through hydraulic fluid, could be used. For example, FIGS. 6 and 7 show an alternate design that uses vanes 180 instead of plungers. However, the remaining construction and operation are the same as described in connection with FIGS. 1–5, the hydraulic chambers 182 and 184 formed between each side of a vane and the housing performing essentially the same function as the chambers 28 and 30 formed by each end of a plunger and the Plunger housing.

We claim:

1. A phaseshifter for varying the phase relationship between a pair of rotating members, including a first driving portion and a second driven portion, and a hydraulic control system operably connecting the portions for angular relative rotation therebetween at times, including a closed hydraulic cylinder fixed to one of the portions and filled with a fluid, a plunger within the cylinder operably connected to the other of the portions and defining pressure chambers between opposite ends of the plunger and its cylinder, and fluid pressure containable passage means hydraulically connected to the opposite end chambers of the cylinder for at times controlling pressurization of the opposite ends of the chamber for effecting movement of the plunger and cylinder relative to each other for rotating the second driven portion relative to the first driving portion, and hydraulic control means operable to permit or block the flow of fluid selectively to and from the end chambers to control said relative movement, said control means including valve means rotatable with one of the portions and axially movably mounted within a bore in the other of the portions, source means supplying fluid under pressure to the bore and at times therefrom through the valve means and the end chamber fluid passages for controlling movement of the plunger, the valve means and bore wall together having a series of spaced helical grooves cooperatingly matingly arranged to selectively control the flow of fluid to and from the opposite ends of the cylinder as a function of the axial movement of the valve means to effect the angular relative rotation, and means selectively moving the valve means between a neutral position blocking both of the end chamber passages, thereby effecting a unitary rotation of the driving and driven portions, and to other positions in opposite directions therefrom to selectively connect or prevent fluid flow to the individual end chambers for controlling the movement of the plunger.

2. A phaseshifter as in claim 1, wherein the driving portion is an internal combustion engine crankshaft driven portion, and the driven portion is a camshaft.

3. A phaseshifter as in claim 1, wherein movement of the valve means in one direction to one of the other positions continues to block the supply of fluid under pressure from the source to the end chambers while connecting the end chambers of the cylinder directly to each other whereby relative movement between the plunger and cylinder effects a transfer of fluid from one end chamber to the opposite end chamber and an angular relative movement between the driven portion and the driving portion, one of the portions being subject to a mean reaction torque to pressurize one of the end chambers to effect the transfer of fluid between the end chambers.

4. A phaseshifter as in claim 3, the effected relative rotation between the portions realigning the valve and outer wall helical grooves to a new neutral position to again block off the end chamber passages and cease the relative rotational phaseshifting movement between the portions.

5. A phaseshifter as in claim 3, wherein the system is self-adjusting in that any unintended relative rotation between the portions causing the valve means to be out of its neutral position will connect the fluid passages in a manner to reverse the relative rotation between the portions and restore the neutral position of the valve means.

6. A phaseshifter as in claim 2, wherein movement of the valve means in one direction to one of the other positions continues to block the supply of fluid under pressure from the source to the end chambers while connecting the end chambers of the cylinder to each other whereby relative movement between the plunger and cylinder effects a transfer of fluid from one end chamber to the opposite end chamber and an angular relative movement between the camshaft portion and the crankshaft driven portion, the camshaft portion being connected to the plunger and being subjected to the mean reaction torque of the engine valve train components to pressurize one of the end chambers to effect the transfer of fluid between the end chambers.

7. A phaseshifter as in claim 6, the effected relative rotation between the portions realigning the valve and outer wall helical grooves to a new neutral position to again block off the end chamber passages and cease the relative rotational phaseshifting movement between the portions.

8. A phaseshifter as in claim 6, wherein the system is self-adjusting in that any unintended relative rotation between the portions causing the valve means to be out of its neutral position will connect the fluid passages in a manner to reverse the relative rotation between the portions and restore the neutral position of the valve means.

9. A phaseshifter as in claim 3, including a check valve in the passage means between chambers Preventing flow of fluid in one direction while Permitting flow in the opposite direction.

10. A phaseshifter as in claim 2, wherein movement of the valve means to one of the other positions connects source fluid under pressure to one of the end chambers to pressurize the same while connecting the other end chamber to vent thereby effecting the angular movement of one of the portions relative to the other.

11. A phaseshifter as in claim 10, the effected relative rotation between the portions realigning the valve and outer wall helical grooves to a new neutral position to again block off the end chamber passages and cease the relative rotational phaseshifting movement between the portions.

12. A phaseshifter as in claim 10, wherein movement of the valve means in the opposite direction to the other one of the positions blocks the communication of the fluid under pressure from the supply source to the passages while connecting the end chambers of the cylinder directly to each other whereby relative movement between the plunger and cylinder effects a transfer of fluid directly form one end chamber to the opposite end chamber and an angular relative movement between the camshaft portion and the crankshaft driven portion, one of the portions being subjected to the mean reaction torque of the engine valve train components to pressurize one of the end chambers to effect the transfer of fluid between the chambers.

13. A phaseshifter as in claim 2, wherein movement of the valve means in one direction to one of the other Positions continues to block the supply of fluid under pressure from the source to the end chambers while connecting the end chambers of the cylinder to each other whereby relative movement between the plunger and cylinder effects a transfer of fluid from one end chamber to the opposite end chamber, thereby effecting angular relative movement between the camshaft portion and the crankshaft driven portion, the camshaft portion being subjected to the mean reaction torque of the engine valve train components to pressurize one of the end chambers to effect the transfer of fluid between the chambers, movement of the valve means in the opposite direction to another of the positions connecting fluid under pressure from the source to one of the end chambers to pressurize the same while connecting the other end chamber to vent thereby effecting movement of one of the portions relative to the other.

14. A phaseshifter as in claim 13, wherein the system is self-adjusting in that any unintended relative rotation between the portions causing the valve means to be out of its neutral position will connect the fluid passages in a manner to reverse the relative rotation between the portions and restore the neutral position of the valve means.

15. A phaseshifter as in claim 13, the effected relative rotation between the portions realigning the valve and outer wall helical grooves to a new neutral Position to again block off the end chamber passages and cease the relative rotational phaseshifting movement between the portions.

16. A phaseshifter as in claim 10, wherein movement of the valve means in the one direction to the one of the other positions connects the source of fluid under pressure to vent while connecting the end chambers of the cylinder directly to each other, the supply of fluid under pressure to the passages being required only in the other position of the valve means.

17. A phaseshifter as in claim 1, wherein the source means supplies a continuous supply of fluid under pressure to the bore, movement of the valve means in either of the opposite directions from the neutral position alternately connecting the source to one or the other of the end passages to pressurize the same while connecting the other end passage to vent thereby effecting relative movement between the plunger and cylinder in one or the other directions to correspondingly rotate the driven portion and driving portion relative to one another in the one or other directions.

18. A phaseshifter as in claim 17, wherein the system is self-adjusting in that any unintended relative rotation between the portions causing the valve means to be out of its neutral position will connect the fluid passages in a manner to reverse the relative rotation between the portions and restore the neutral position of the valve means.

19. A phaseshifter as in claim 17, the effected relative rotation between the portions realigning the valve and outer wall helical grooves to a new neutral position to again block off the end chamber passages and cease the relative rotational phaseshifting movement between the portions.

20. A phaseshifter as in claim 1, wherein the plunger is of the vane type.

21. A phaseshifter as in claim 1, wherein the helical grooves include one set of spaced grooves in the bore wall and a second set of matching grooves in the valve means outer surface, the movement of the valve means aligning or misaligning the grooves selectively to control fluid flow to and from the passages.

22. A phaseshifter as in claim 2, wherein the first portion is a crankshaft driven housing having a bore therein defining the cylinder, the second camshaft portion being centrally located within and surrounded by the housing and having a flange extending radially outwardly therefrom, means connecting the plunger to the flange for disposal within the cylinder bore with the longitudinal axis of the plunger in a plane essentially perpendicular to the axis of the camshaft, the valve means being coaxially located within the camshaft.

23. A phaseshifter for varying the phase relationship between two rotating members, including a first portion connected to a crankshaft driven member, and a second portion connected to a camshaft member, and a hydraulic control system operably connecting the portions for angular relative rotation therebetween at times, including a pair of closed hydraulic cylinders fixed to one of the portions and filled with a fluid, a plunger within each of the cylinders operably connected to the other of the portions and defining pressure chambers between opposite ends of each plunger and its cylinder, and fluid passage means at times hydraulically interconnecting the opposite end chambers of each cylinder to each other whereby relative movement between the plunger and cylinder effects a transfer of fluid from one end chamber to the opposite end chamber, and vice versa, thereby effecting angular relative movement between the camshaft member and the crankshaft driven member, the camshaft member and plungers being subjected to the mean reaction torque of the engine valve train components to pressurize one of the ends of each chamber to rotate the camshaft member in one direction relative to the crankshaft member upon relative movement between the plungers and the cylinders, and hydraulic control means operable at times to control the flow of fluid from one cylinder end chamber to its opposite end chamber to provide said relative movement, and at other times being operable to supply fluid under pressure directly to one or the other of the end chambers while venting the opposite end chamber to provide another relative movement between the plungers and cylinders to provide angular relative movement between the camshaft member and crankshaft driven member, said control means including valve means axially movably mounted within a bore in the camshaft member, means supplying oil under pressure to the bore and therefrom at the other times to the end chamber fluid passages for controlling movement of the plungers, the valve means and bore wall having a series of spaced helical grooves cooperatingly arranged to selectively control the flow of fluid to and from opposite ends of the cylinders or block the same as a function of the axial movement of the valve means, and means selectively moving the valve means.

24. A phaseshifter as in claim 23, wherein the system is self-adjusting in that any unintended relative rotation between the portions causing the valve means to be out of its neutral position will connect the fluid passages in a manner to reverse the relative rotation between the portions and restore the neutral position of the valve means.

25. A phaseshifter for varying the phase relationship between two rotating members, including a first driving portion and a second driven portion, and means for providing a relative movement between the two members, said means including a closed hydraulic cylinder connected to one portion and a plunger receivable therein connected to the other portion, with end fluid chambers between the plunger and cylinder, passage means interconnecting the end chambers, and fluid pressure control means operable to control the exchange of fluid to and from and between the respective chambers to prevent or effect relative movement between the portions to vary the phase relationship, the driven portion being acted upon by and movable in an arcuate direction when permitted to do so in response to the mean reaction torque pulses of the engine thereto applied through the engine valve train components, and other means to render the fluid pressure control means operable and inoperable, said other means including a bore within the driven camshaft member containing a source of oil under pressure, an axially movable but non-rotatably mounted valve within the bore movable between a neutral position blocking oil flow from the source to the end chambers and movable to other positions selectively supplying oil to the end chambers, and a series of spaced helical grooves in both the wall defining the bore and the outer surface of the valve adapted to be aligned at times with each other in different sequences as a function of the axial movement of the valve to control the supply and vent of fluid to and from the end chambers and the direct exchange of fluid between the end chambers of the cylinders.

26. A phaseshifter as in claim 25, wherein the system is self-adjusting in that any unintended relative rotation between the portions causing the valve means to be out of its neutral position will connect the fluid passages in a manner to reverse the relative rotation between the portions and restore the neutral position of the valve means.

27. A phaseshifter as in claim 25, the effected relative rotation between the portions realigning the valve and other wall helical grooves to a new neutral position to again block off the end chamber passages and cease the relative rotational phaseshifting movement between the portions.

28. A phaseshifter for varying the phase relationship between two rotating members, including a first crankshaft driven portion, and a second camshaft portion, and a hydraulic control system operably connecting the portions for angular relative rotation therebetween at times, including a pair of closed hydraulic cylinders fixed to one of the portions and filled with a fluid, a plunger within each of the cylinders operably connected to the other of the portions and defining pressure chambers between opposite ends of each plunger and its cylinder, and fluid pressure passage means hydraulically connected to each end chamber of each cylinder for selectively pressurizing ends of each chamber while venting the opposite ends for rotating the second camshaft portion relative to the first crankshaft Portion upon relative movement between the plungers and the cylinders, and hydraulic control means including valve means rotatable with one of the portions and axially movably mounted within a bore in the other of the portions, means supplying oil under pressure to the bore and therefrom selectively to the end chamber fluid passages for controlling relative movement between the cylinders and the plungers, the valve means and bore wall having a series of spaced helical grooves cooperatingly matingly arranged to selectively control the flow of fluid to and from the ends of the cylinders as a function of the axial movement of the valve means to effect the angular relative rotation, and means selectively moving the valve means between a neutral position blocking both of the end chamber passages, thereby effecting a unitary rotation of the driving and driven portions, and to other positions in opposite directions therefrom to selectively connect or prevent fluid flow to the individual end chambers for controlling the movement of the plunger, the effected relative rotation between the portions concurrently realigning the bore wall grooves with the valve helical grooves to a new neutral position to again block off the end chamber passages and cease the relative rotational phaseshifting movement between the portions.

29. A phaseshifter as in claim 28, wherein the system is self-adjusting in that any unintended relative rotation between the portions causing the valve means to be out of its neutral position will connect the fluid passages in a manner to reverse the relative rotation between the portions and restore the neutral position of the valve means.

* * * * *